United States Patent [19]

Bond

[11] 4,245,390

[45] Jan. 20, 1981

[54] SCORING ATTACHMENT FOR POWER SAWS

[76] Inventor: David L. Bond, 13325 Applewood Dr., Grandview, Mo. 64030

[21] Appl. No.: 25,671

[22] Filed: Mar. 30, 1979

[51] Int. Cl.[3] ..... B27B 9/00

[52] U.S. Cl. ..... 30/164.95; 30/374; 83/863; 144/3 R

[58] Field of Search ..... 30/371, 374, 388, 390, 30/164.95; 83/441.1, 863; 144/3 R

[56] References Cited

U.S. PATENT DOCUMENTS

| | | | |
|---|---|---|---|
| 1,753,959 | 4/1930 | Wikstrom | 30/374 |
| 2,487,327 | 11/1949 | Ganter | 30/167 |
| 2,996,089 | 8/1961 | McCarty | 30/374 |
| 3,421,556 | 1/1969 | Clifford | 144/3 R |
| 3,623,518 | 11/1971 | Nicotra | 30/374 |
| 4,087,914 | 5/1978 | Bates | 30/374 |
| 4,174,745 | 11/1979 | Benuzzi | 144/3 R |

*Primary Examiner*—Jimmy C. Peters
*Attorney, Agent, or Firm*—Fishburn, Gold and Litman

[57] ABSTRACT

A scoring device for attachment to a shoe plate of a power hand saw includes a mounting structure having an elongate base member with opposite ends engageable in spaced saw rip guide brackets for extending transversely on the shoe plate forwardly of the saw blade. An upper bar member is slidably mounted atop the base member and longitudinally selectively positionable thereto. A scoring wheel for cutting into the outer surface of an article to be sawn has a sharp edge and is rotatably mounted between spaced arms connected to the bar member for vertical swinging movement. The wheel is selectively positioned with the bar member so that the wheel edge cuts a continuous score line or indentation over the entire line of intended sawing and generally aligned with the saw blade. A spring extends between the bar member and one of the arms for urging at least portion of the scoring wheel below the shoe plate and into penetrating relation with the article surface for preventing splintering of the surface portion of the wood by the following saw blade.

8 Claims, 5 Drawing Figures

SCORING ATTACHMENT FOR POWER SAWS

This invention relates to devices for attachment to power driven hand saws and particularly to such devices which travel ahead of the saw and act upon the article to be cut.

A particular problem encountered by carpenters when cutting veneer panels, doors, plywood and the like across the grain thereof is splintering of the wood which renders the sawn edge unsightly and if too severe, unsuitable for the work. To prevent this occurrence, the usual course has been to lay a straight edge or rule along a pencil line to be cut and, using a pocketknife or the like, manually score the line, thereby cutting through the top layer of wood fibers which would otherwise splinter. Then, in a separate action, a power driven saw is guided along the score line to saw the article into separate pieces. These steps are time-consuming and ultimately increase the cost of construction.

Various devices for attachment to hand held, power driven saws are known and include such attachments as toothed wheels or rowels which mount to saw structure forwardly of the saw blade and aid straight line tracking of the saw as it travels along a pencil mark indicating the line of cut. The teeth of these wheels individually dig into the surface of the article to be sawn and create a dotted or dashed line extending along the pencil mark but do not attempt to prevent splintering or chipping of the article surface. When the dotted or dashed line is aligned with the cutting direction of the saw blade used, the toothed wheels or rowels may actually promote splintering or chipping by concentrating the outward force of the saw blade at the unmarked spaces along the line. Therefore, these toothed wheel tracking attachments are believed to be inappropriate to the device herein described and shown.

The object of the present invention are to provide a scoring device for attachment to a power hand held saw; to provide such a scoring device which has a continuous, sharp, knife-edged wheel or blade for incising a score through an article surface and preventing splintering of the surface when the article is cut by the saw blade; to provide such a scoring device which is transversely adjustable relative to the saw blade for selectively controlling the position of the score line relative to a cut line; to provide such a scoring device which has a spring urging the blade downward of a saw shoe plate and into scoring engagement with an article surface; and to provide such a scoring device which is relatively inexpensive, highly reliable in use and well adapted for its intended purpose.

Other objects and advantages of this invention will become apparent from the following description taken in connection with the accompanying drawings wherein are set forth by way of illustration and example, certain embodiments of this invention.

Figure 1:
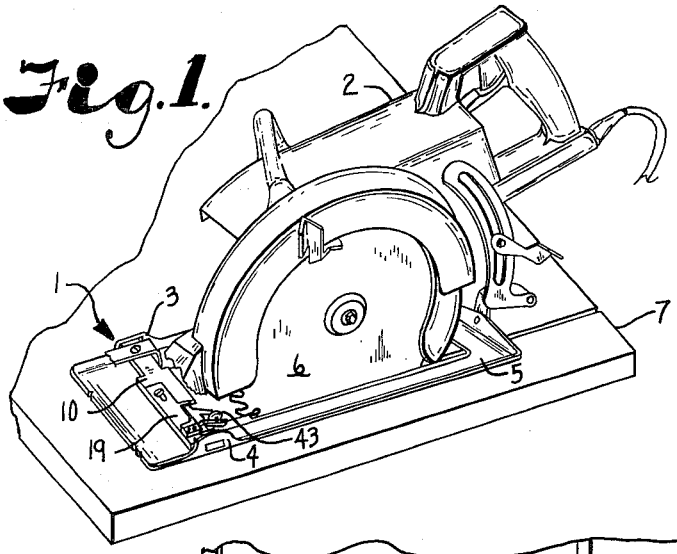
FIG. 1 is a perspective view of a power driven hand held saw having a scoring device embodying this invention attached thereto and shown in connection with an article being cut.
Figure 3:
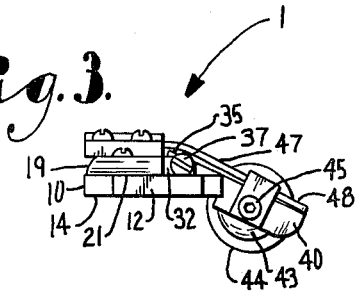
FIG. 3 is an end elevational view of the scoring device.

As required, a detailed embodiment of the present invention is disclosed herein, however, it is to be understood that the disclosed embodiment is merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Referring more in detail to the drawings:

The reference numeral 1 generally indicates a scoring device embodying the present invention in which the device is removably connected to a power driven hand held saw such as a circular saw 2 whereby the scoring device 1 is engaged in spaced brackets 3 and 4 normally receiving a rip guide or the like therein and upon a shoe plate 5 and forwardly of a saw blade 6 thereof for incising a score line through an article 7 subject to splintering.

The teeth of saws tend to splinter or chip the article being cut on the surface facing the direction of rotation of the saw blade through the article. This may be on either the top or bottom surface of the article depending upon the position of the rotational axis of the saw blade above or below the article. Accordingly, the scoring device 1 is shown in the illustrated example, FIGS. 1 and 2, connected to suitable mounting portions of a saw positioned on the side of the article on which splinters tend to occur so that splinters or chips may be prevented as described below.

The exemplary scoring device 1 includes an elongate base member 10 having opposite tang ends 11 and 12 sized for insertion into the rip guide brackets 3 and 4 and planar upper and lower surfaces 13 and 14. A tang end 11 has a greater length than the tang end 12 and extends through a fastening bracket 15 on the surface of the shoe plate 5 with a connector such as a screw 16 therethrough for bearing upon the upper surface 13 and securing the base member 10 to the rip guide brackets 3 and 4.

An upper bar member 19 is mounted atop portions of the base member 10 between the tang ends 11 and 12 and has planar upper and lower surfaces 20 and 21, the lower surface 21 smoothly engaging the upper surface 13 of the base member 10. Opposite ends 22 and 23 have longitudinally elongate respective apertures 24 and 25 through which fasteners, such as screws 26 and 27 are extended and selectively tightenable to permit longitudinal sliding translation and selective positioning of the upper bar member 19 on the base member 10 the length of the apertures 24 and 25.

The base member 10 has an opening 29 extending partly along a rear edge 30 thereof and the upper bar member 19 has spaced ears 31 and 32 projecting therefrom over the opening 29. A mounting bracket 34 has a connecting portion 35 positioned between the ears 31 and 32 and pivotally connected thereto by screws 36 and 37 for vertical swinging movement relative to the bar member 19 and base member 10. Spaced arms 39 and 40 extend outwardly from the connecting portion 35 and toward the saw blade 6.

A circular wheel 43 is preferably formed of a durable material suitable for cutting purposes, such as steel, and has a continuous, sharp, knife-like edge 44 extending around the margin thereof. The wheel 43 is mounted between the spaced arms 39 and 49 by a suitable axle such as a bolt 45 extending through the arms 39 and 40 and permitting rotation of the wheel 43 as the sharp edge 44 cuts through the fibers in the outer surface of the article 7. An indentation thus cut by the sharp edge 44 extends the entire length of the line of cut in an unbroken score or line to prevent the occurrence of splinters, chips or the like.

For urging the mounting bracket 34 and the wheel 43 downwardly through an opening 46 in the shoe plate 5 so that the sharp edge 44 cuts into the article 7, a relatively stiff spring 47 extends between the mounting bracket 34 and the bar member 19. The spring 47 has a first end 48 attached to the arm 40 by an L-shaped connector 49 and a second end 51 attached to the upper surface 20 of the bar member 19 by a mounting block 52 secured by fasteners such as screws 53.

In the use of the scoring device 1, the screw 16 is loosened and the tang 11 of the base member 10 inserted under the bracket 15 and through the rip guide bracket 3 until the tang 12 can be moved downwardly and into the rip guide bracket 4. The screw 16 is then tightened to secure the base member 10 to the shoe plate 5 whereby the scoring device 1 is positioned transversely on the shoe plate 5 and forwardly of the saw blade 6.

The spring 47 urges the mounting bracket 34 downwardly so that at least a portion of the sharp edge 44 extends through the opening 46 of the shoe plate 5 for engagement with the outer surface of the article 7.

Figure 2:
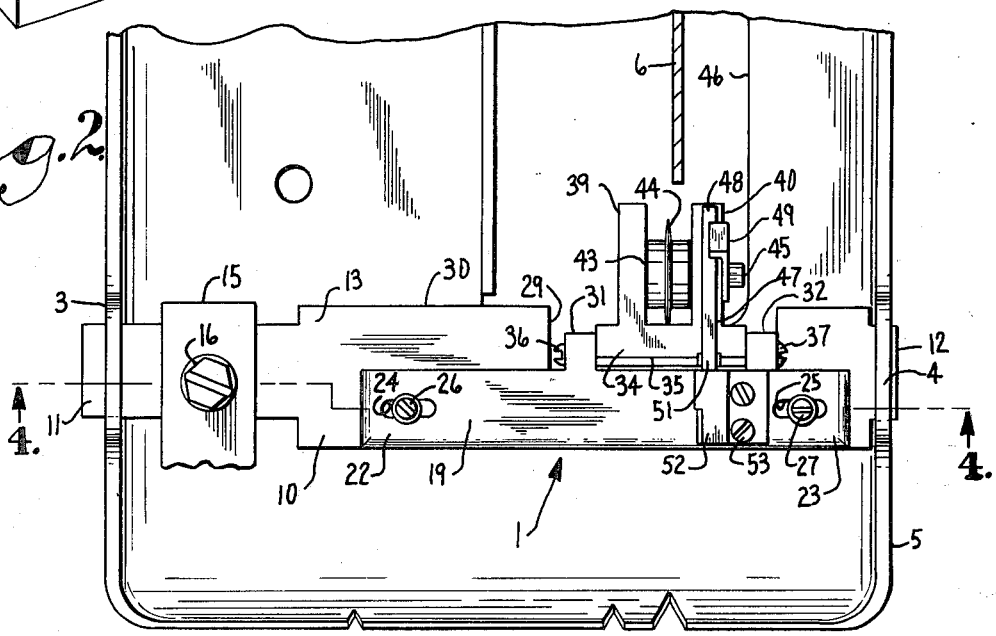
FIG. 2 is a fragmentary, top plan view of the scoring device, saw blade and a shoe plate of the saw.
Figure 4:
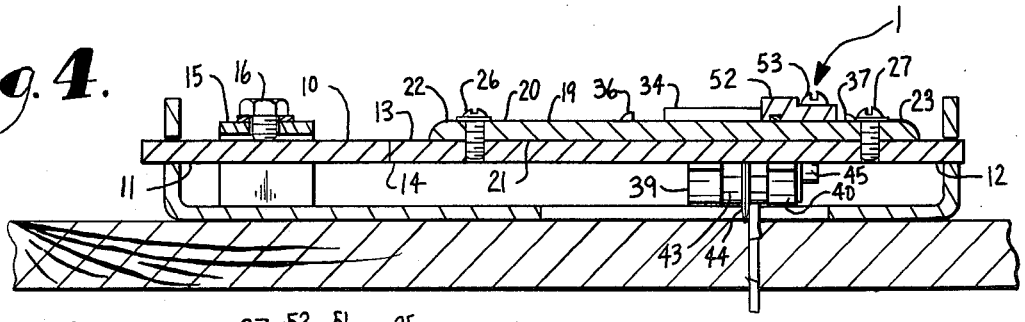
FIG. 4 is a longitudinal sectional view of the scoring device, shoe plate and workpiece or article taken along lines 4—4, FIG. 2.
Figure 5:
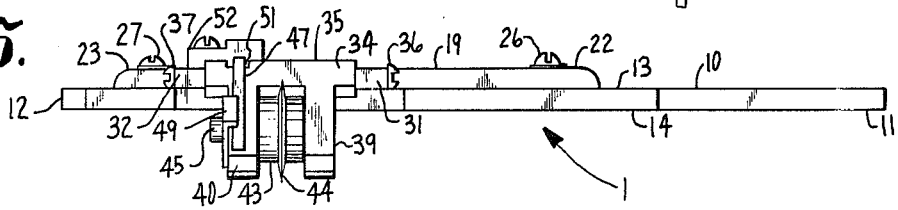
FIG. 5 is a rear elevational view of the scoring device.

Preferably, the cutting direction of the sharp edge 44 is generally longitudinally aligned with the cutting direction of the saw blade 6, FIG. 2, and positioned a slight distance to one side of the article 7 being cut preferably on the side of the article to be retained. In use, the saw 2 is brought into contact with the article 7 and aligned with a pencil mark or the like on the article indicating the line of cut. As the saw 2 travels along the pencil mark, the sharp edge 44 incises a score or line of indentation through the article surface and cuts the surface fibers of the article the entire length of the line of the cut so that the fibers are not ripped outwardly to form splinters as the saw blade 6 passes therethrough. Therefore, use of the scoring device 1 permits an article such as a door, wall panel, plywood sheet, board or the like to be cut across the grain thereof in a single step without splintering, chipping or the like and thereby leaves a smooth, finished saw line.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A scoring device for preventing splintering of an article and for attachment to a saw having a power driven saw blade and a planar structure for engaging an article to be sawn, said scoring device comprising:

(a) a wheel having a sharp, knife-like, continuous cutting edge therearound;

(b) mounting means for rotatably attaching said wheel to the planar structure of a saw adjacent to a saw blade so that said wheel has a cutting direction substantially parallel with the path of the saw blade as it moves through an article, said mounting means having biasing means therewith urging said wheel outwardly so that the cutting edge thereof extends outwardly from the saw planar surface to engage and continuously penetrate a surface portion of the article being moved relative thereto so that said wheel rotates at a corresponding rate of speed to the speed the saw moves over the article to be sawn for forming an indented continuous line in the surface portion which would thereby prevent splintering when said article is sawn.

2. The scoring device set forth in claim 1 wherein:

(a) said planar surface is a shoe plate mounted to a lower portion of the saw for slidably contacting the surface portion of the article to be sawn; and (b) said shoe plate has an elongate opening therein through which said saw blade and said cutting edge extend outwardly.

3. The scoring device set forth in claim 2 wherein:

(a) said mounting means are adjustably translatable transversely on said shoe plate with respect to the saw blade; and including (b) locking means to secure said mounting means in a selected position with said cutting direction of said wheel substantially colinear with the path of the saw blade.

4. The scoring device set forth in claim 3 wherein:

(a) said mounting means includes an elongate base member adapted to be removably secured to said shoe plate and extending transversely across a forward end of said shoe plate and a bar member slidably mounted on and transversely translatable with respect to said base; and (b) a fastener selectively fixing said bar member relative to said base member.

5. The scoring device set forth in claim 4 including:

(a) spaced arms extending outwardly of said bar member with said wheel rotatably mounted therebetween.

6. A scoring device for preventing splintering of an article surface when the article is sawn and for attachment to a shoe plate of a power driven hand saw having spaced brackets and a circular saw blade, said scoring device comprising:

(a) an elongate base member having opposite ends and adapted to be removably secured to a shoe plate of a hand saw and extending transversely across a forward end of the shoe plate with said opposite ends engaged in spaced brackets on said shoe plate;

(b) an upper bar member slidably mounted atop said base member and selectively positionable across a portion of said shoe plate;

(c) a fastener selectively locking said bar member to said base member;

(d) spaced arms swingably mounted to said bar member and extending outwardly thereof;

(e) a wheel having a sharp, knife-like cutting edge therearound and rotatably mounted between said arms with a cutting direction of said cutting edge selectively and substantially in the path of the saw blade as the saw blade moves through an article being moved relative thereto;

(f) a spring extending between said bar member and said arms for urging said wheel downwardly so that said cutting edge extends below the shoe plate to penetrate a surface portion of the article for forming an indented line in the surface portion which thereby prevents splintering when sawn.

7. A scoring device for preventing splintering of an article and for attachment to a saw having a power driven saw blade and a planar structure for engaging an article to be sawn, said scoring device comprising:

(a) a wheel having a sharp, knife-like, cutting edge therearound;

(b) mounting means for rotatably attaching said wheel to the planar structure of a saw adjacent to a saw blade and substantially in the path of the saw blade as it moves through an article so that the cutting edge extends outwardly from the planar surface to penetrate a surface portion of the article being moved relative thereto for forming an indented line in the surface portion which would thereby prevent splintering when sawn.

(c) said planar surface is a shoe plate mounted to a lower portion of the saw for slidably contacting the surface portion of the article to be sawn; and (d) said shoe plate has an elongate opening therein through which said saw blade and said cutting edge extend;

(e) said mounting means are adjustably translatable transversely on said shoe plate with respect to the saw blade;

(f) locking means to secure said mounting means in a selected position with said cutting edge substantially in the path of the saw blade;

(g) said mounting means includes an elongate base member adapted to be removably secured to said shoe plate and extending transversely across a forward end of said shoe plate and a bar member slidably mounted on said base;

(h) said locking means include a fastener selectively fixing said bar member relative to said base member; and (i) spaced arms extending outwardly of said bar member with said wheel rotatably mounted therebetween;

(j) said arms are swingably mounted to said bar member for up and down movement of said wheel; and including (k) biasing means urging said arms and said wheel downwardly of said base member for engaging said cutting edge with the article surface.

8. A scoring device for preventing splintering of an article surface when the article is sawn and for attachment to a shoe plate of a power driven hand saw having a circular saw blade, said scoring device comprising:

(a) an elongate base member having opposite ends and adapted to be removably secured to a shoe plate of a hand circular saw and extending transversely across a forward end of the shoe plate with said opposite end engaged with said shoe plate;

(b) bifurcated arms forming a yoke rotatably supporting said wheel and swingably connected to said base member and extending outwardly thereof;

(c) a wheel having a sharp, knife-like, continuous, cutting therearound and rotatably mounted between said arms with a cutting direction of said cutting edge substantially in and parallel with the path of the saw blade as the saw blade moves through an article being moved relative thereto;

(d) a spring connected between said base member and said arms for urging said wheel downwardly into engagement with a surface portion of an article to be sawn and so that said wheel rotates on said surface portion at a rate of speed corresponding to the rate the saw moves over the surface portion and so that said cutting edge extends below the shoe plate to penetrate a surface portion of the article for forming a continuous indented line in the surface portion which thereby prevents splintering when sawn.

* * * * *